US007131503B2

(12) United States Patent
Furuta et al.

(10) Patent No.: US 7,131,503 B2
(45) Date of Patent: Nov. 7, 2006

(54) IMPACT DRIVER HAVING A PERCUSSION APPLICATION MECHANISM WHICH OPERATION MODE CAN BE SELECTIVELY SWITCHED BETWEEN PERCUSSION AND NON-PERCUSSION MODES

(75) Inventors: Takefumi Furuta, Anjo (JP); Hidenori Nagasaka, Anjo (JP)

(73) Assignee: Makita Corporation, Anjo (JP)

( * ) Notice: Subject to any disclaimer, the term of this patent is extended or adjusted under 35 U.S.C. 154(b) by 0 days.

(21) Appl. No.: 11/045,380

(22) Filed: Jan. 31, 2005

(65) Prior Publication Data

US 2005/0173139 A1 Aug. 11, 2005

(30) Foreign Application Priority Data

Feb. 10, 2004 (JP) ..... 2004-034016

(51) Int. Cl.
*B25B 23/159* (2006.01)

(52) U.S. Cl. ..... 173/48; 173/104; 173/93; 173/93.5; 173/216; 173/112; 173/206; 173/109

(58) Field of Classification Search ..... 173/48, 173/104, 93, 93.5, 216, 205, 109, 112, 178, 173/91
See application file for complete search history.

(56) References Cited

U.S. PATENT DOCUMENTS 4,098,351 A * 7/1978 Alessio ..... 173/13
5,458,206 A * 10/1995 Bourner et al. ..... 173/178
6,015,017 A * 1/2000 Lauterwald ..... 173/48
6,142,242 A * 11/2000 Okumura et al. ..... 173/48
6,688,406 B1 * 2/2004 Wu et al. ..... 173/48
6,892,827 B1 * 5/2005 Toyama et al. ..... 173/48
2005/0199404 A1 * 9/2005 Furuta et al. ..... 173/48

FOREIGN PATENT DOCUMENTS

JP A 2002-273666 9/2002

* cited by examiner

*Primary Examiner*—Sameh H. Tawfik
*Assistant Examiner*—Brian Nash
(74) *Attorney, Agent, or Firm*—Oliff & Berridge, PLC

(57) ABSTRACT

An impact driver capable of boring and having an excellent usability is provided. An anvil(8) is arranged so as to slightly move in the axial direction. A first cam(29) having cam gears(30, 30 . . . ) is externally provided at the anvil so as to be integral with the anvil(8). At the rear of the first cam(29), a second cam(31) having cam gears(32, 32 . . . ) and further having cam gears(36, 36 . . . ) at its outer circumference is externally provided to the anvil(8) so as to be rotatable. At the backward position of the anvil(8), the cam gears(30, 32) contacts with each other. On the other hand, in the cylindrical portion(27) of the hammer case(5), an engaging pin(37) capable of engaging with an engaging gear(36) of the second cam(31) is provided. The engaging pin(37) can change its location by the rotative operation of a mode-change ring(40), whereby a percussion mode and a non-percussion mode is selected.

6 Claims, 6 Drawing Sheets

IMPACT DRIVER HAVING A PERCUSSION APPLICATION MECHANISM WHICH OPERATION MODE CAN BE SELECTIVELY SWITCHED BETWEEN PERCUSSION AND NON-PERCUSSION MODES

BACKGROUND OF THE INVENTION

This application claims the benefit of Japanese Patent Application No. 2004-34016 filed Feb. 10, 2004, the entirety of which is incorporated by reference.

1. Field of the Invention

The present invention relates to an impact driver capable of applying rotation and the intermittent impact operation to an output shaft.

2. Description of the Related Art

An impact driver includes a rotation impact mechanism provided between a motor housed in a housing and an output shaft protruding from the housing so as to transfer a motor torque to the output shaft as well as apply the impact operation to the same in the rotative direction in accordance with increase of a load on the output shaft. For example, Japan Published Unexamined Patent Application No. 2002-273666 discloses a rotation impact mechanism in which a spindle rotated by a motor is connected to a hammer through cam grooves and balls, and an anvil (an output shaft) attachable to and detachable from the hammer in the rotative direction is provided in front of the hammer, whereby rotation of the spindle is transferred to the anvil through the hammer. With this structure, when a load on the anvil exceeds a predetermined value, the hammer moves backward along the cam grooves to temporarily disengage from the anvil, and thereafter it moves forward by a coil spring biased to the front along the cam grooves to reengage with the anvil. By repeating the above operation, it is possible to apply the intermittent impact operation to the anvil in the rotative direction.

The above-described impact driver is generally used for screwing with a screw or a bolt etc. Thus, when it is used for screwing an anchor bolt on a material to be processed like a plaster board etc., a percussion drill is used first for boring and then an impact driver is used to screw the anchor bolt into a processed hole. This means that a user has to handle two separate tools in turn, which are, the percussion drill and the impact driver. Consequently, it is troublesome to exchange tools and therefore usability might be reduced.

SUMMARY OF THE INVENTION

In order to solve this problem, an object in accordance with a first aspect of the present invention is to provide an impact driver capable of boring by percussion easily and providing an excellent usability.

In order to achieve the above object, in the first aspect of the present invention, the output shaft is provided so that it can slightly move back and forth in the axial direction and a percussion application mechanism is arbitrarily provided for allowing the output shaft to generate percussion in the axial direction in accordance with the rotation of the output shaft.

In a second aspect of the present invention based on the first aspect, in order to simply form the percussion application mechanism, the percussion application mechanism comprises a first cam externally provided at the output shaft for rotating integrally with the same, a second cam inserted into the output shaft with play at the rear of the first cam and regulated its moving in the axial direction, cam gears formed on the first and second cam at opposing faces thereof for contacting each other at the backward position of the output shaft, and a regulating means provided with the housing and capable of regulating rotation of the second cam arbitrarily from the outside of the housing.

In a third aspect of the present invention based on the second aspect, in order to simply form the regulating means on a position suitable for easy handling, the regulating means comprises an operating member provided at the outside of the housing and an engaging member for moving inward and outward with respect to the second cam in accordance with the operation of the operating member and engages with the second cam at an inward position.

In a fourth aspect of the present invention based on the first aspect, with the impact driver having a chuck sleeve for attaching or detaching a tool at the top of the output shaft by sliding operation in the axial direction, in order to simply form the percussion application mechanism, the percussion application mechanism comprises a first cam externally provided at the output shaft for rotating separately from the output shaft and on which a part of the chuck sleeve mounts externally, a second cam inserted into the output shaft with play at the rear of the first cam and fixed to the side of the housing, cam gears formed on the first and second cams at opposing faces thereof for contacting each other at the backward position of the output shaft, and a regulating means provided between the chuck sleeve and the output shaft and capable of arbitrarily regulating the rotation of the first cam by means of the rotative operation of the chuck sleeve.

In a fifth aspect of the present invention based on the fourth aspect, in order to simply form the regulating means on a position suitable for easy handling, the regulating means comprises a portion to be engaged provided at the outer circumference of the output shaft and an engaging member inserted into the first cam with play in the radial direction and moving inward and outward with respect to the output shaft in accordance with the rotative operation of the chuck sleeve for engaging with the portion to be engaged at an inward position.

According to the first aspect of the present invention, as a percussion mode can be selected by the percussion application mechanism, both boring and screwing can be conducted with an impact driver only, whereby improvement of its operability can be expected.

According to the second aspect of the present invention, in addition to the effect of the first aspect, the percussion application mechanism can be simply formed.

According to the third aspect of the present invention, in addition to the effect of the second aspect, the regulating means can be simply formed at the front edge of the housing where handling is easy.

According to the fourth aspect of the present invention, in addition to the effect of the first aspect, the chuck sleeve is used as an operating member for changing modes, which is a part of the regulating means. Consequently, an impact driver of the present invention can be obtained from a conventional one with only a slight model change, having a great advantage that the percussion application mechanism can be formed with a reduced cost.

According to the fifth aspect of the present invention, in addition to the effect of the fourth aspect, the regulating means can be simply formed at the front edge of the output shaft where handling is easy.

DETAILED DESCRIPTION OF THE PREFERRED EMBODIMENTS

Hereinafter, preferred embodiments of the present invention will be explained with reference to the drawings.

<First Embodiment>

Figure 1:
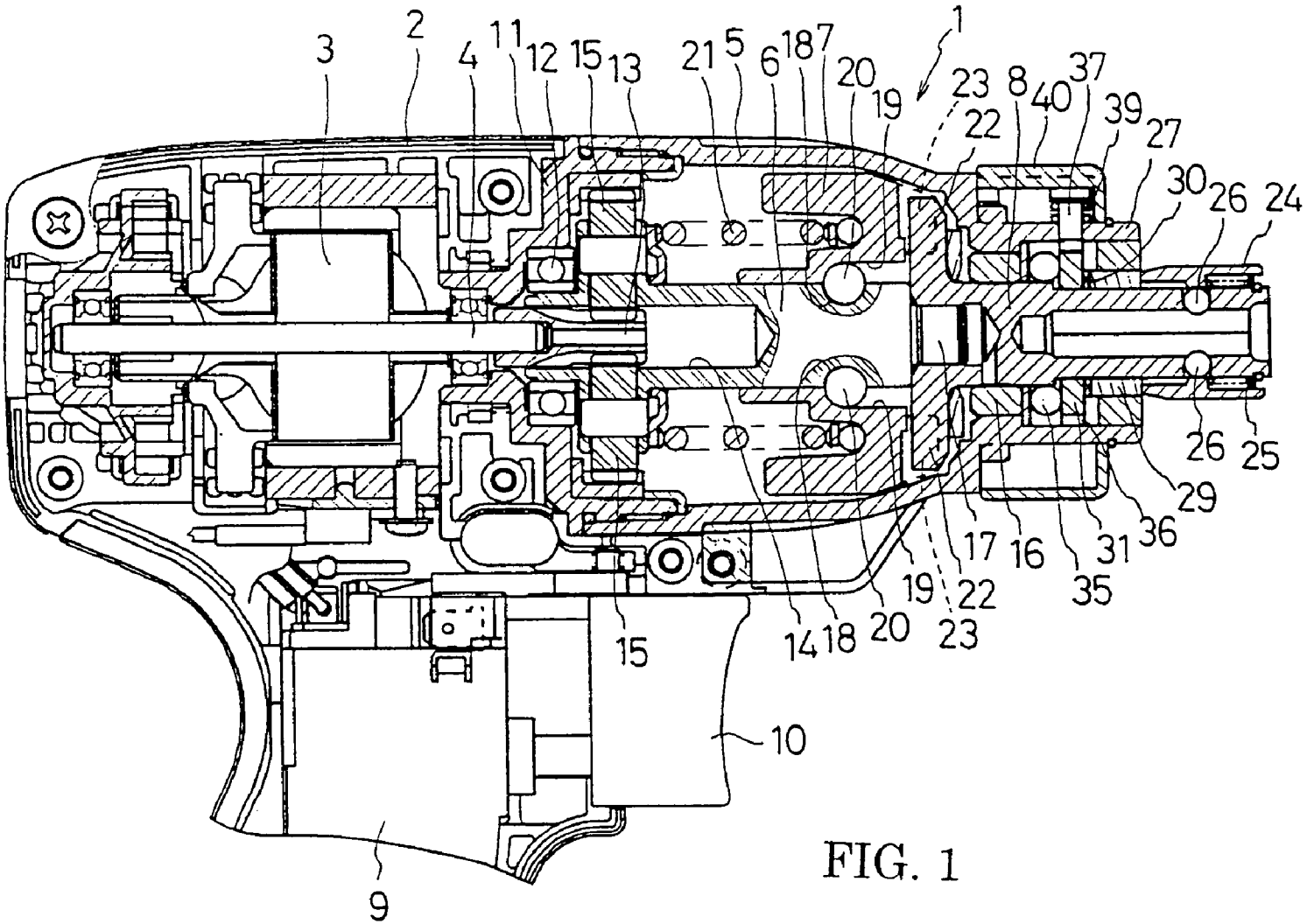
FIG. 1 is a partial vertical section view of an impact driver of the first embodiment (a percussion mode).

FIG. 1 is a partial vertical section view showing an example of an impact driver. An impact driver 1 has a motor 3 accommodated in a body housing 2. At the front of the body housing 2, a hammer case 5 accommodating a spindle 6 and a hammer 7 is mounted as a front housing. An anvil 8 serving as an output shaft protrudes at the front of the hammer case 5. The reference number 9 denotes a switch and the reference number 10 denotes a trigger. Between the body housing 2 and the hammer case 5, a gear housing 11 is provided which axially supports a motor shaft 4 of the motor 3 so as to allow the motor shaft 4 to protrude into the hammer case 5. Moreover, the gear housing 11 axially supports the end of the spindle 6 through a ball bearing 12. A pinion 13 is mounted at the top of the motor shaft 4 which inserts coaxially with play into a hollow portion 14 formed at the end of the spindle 6. In accordance with this structure, the motor shaft 4 engages with a plurality of planetary gears 15, 15 . . . which are axially provided at the outer circumference of the rear of the spindle 6 which receives the reduced speed of rotation of the motor shaft 4.

The anvil 8 is axially supported at the front edge of the hammer case 5 so as to rotate by means of a bearing 16. At the front edge, the spindle 6 has a small-diameter unit 17 inserted coaxially into the end face of the anvil 8 with play. At the rear of the small-diameter unit 17, the hammer 7 is externally provided. The hammer 7 is connected to the spindle 6 so as to be integrally rotatable through two steel balls 20, 20 each of which partially abuts both a pair of cam grooves 18, 18 formed with a slope at the outer circumference of the spindle 6 and a pair of connecting grooves 19, 19 formed in the axial direction at the inner circumference of the hammer 7 respectively. Moreover, the hammer 7 is pressed forward at the rear thereof by a coil spring 21 provided externally to the spindle 6. At the front of the hammer 7, a pair of engaging nails 23, 23 is provided so as to engage with a pair of arms 22, 22 extending in the radial direction at the rear edge of the anvil 8. When the hammer 7 is pressed forward as shown in FIG. 1, the engaging nails 23, 23 engage with the arms 22, 22, thereby allowing the hammer 7 to be integral with the anvil 8 in the rotative direction. The reference number 24 denotes a chuck sleeve externally provided at the top of the anvil 8. In a normal state, the chuck sleeve is located at a backward position by means of a coil spring 25 as shown in FIG. 1, where balls 26, 26 inserted into the anvil 8 protrude in the direction of the center of axis of the anvil 8. Whereby, a driver bit and the like can be mounted on the anvil 8.

Figure 2:
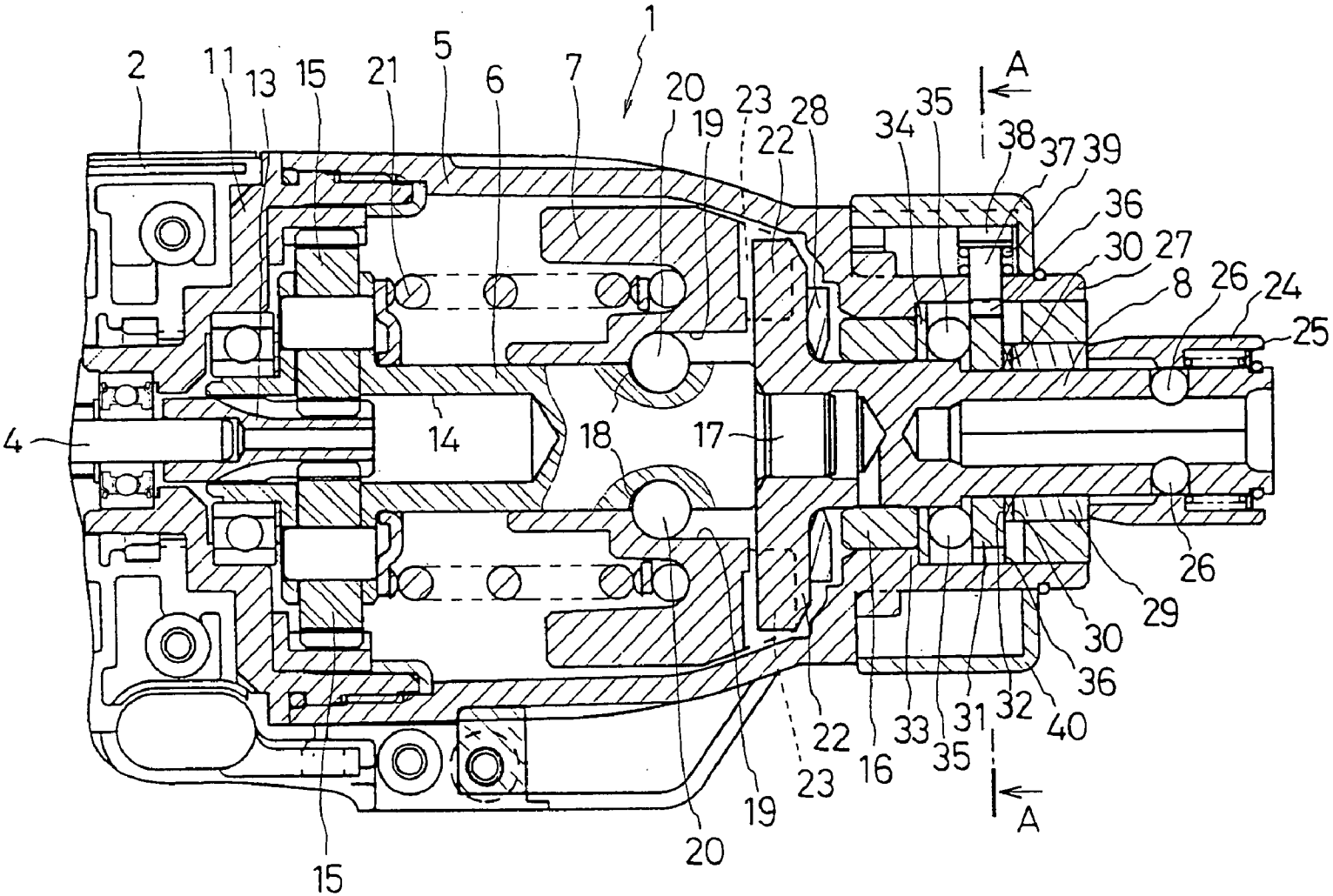
FIG. 2 is an enlarged cross section view of the top portion of the impact driver.
Figure 3:
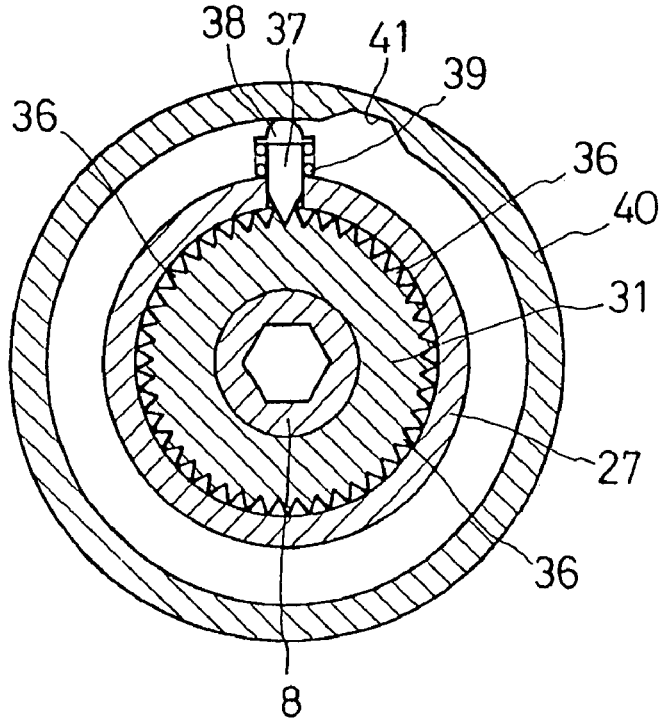
FIG. 3 is a cross section view taken along line A—A of the impact driver.

In the hammer case 5, a percussion application mechanism is provided at a position of a cylindrical portion 27 which is axially supports the anvil 8 at the top of the hammer case 5. As shown in FIG. 2, the anvil 8 is arranged so as to move slightly back and forth in the axial direction between a backward position where the end of the anvil 8 abuts a large-diameter unit of the spindle 6 and a forward position where a washer 28 externally provided in front of the arms 22, 22 abuts to the hammer case 5. At a position adjacent to the front edge of the cylindrical portion 27, a cylindrical first cam 29 having cam gears 30, 30 . . . on its rear surface in the radial direction is externally provided so as to be integral with the anvil 8. At the rear of the first cam 29, a disk-shaped second cam 31 having cam gears 32, 32 . . . on its front surface in the radial direction is externally provided so as to be rotatable. The second cam 31 is regulated its backward position by a flat washer 34 received on a step portion 33 which is formed at the rear of the inner circumference of the cylindrical portion 27, and a plurality of balls 35, 35 . . . disposed in front of the step portion along the circumference of the anvil 8. The cam gears 30 of the first cam 29 and the cam gears 32 of the second cam 31 contact with each other when the anvil 8 is at the backward position. As shown in FIG. 3, engaging gears 36, 36 . . . are provided entirely at the outer circumference of the second cam 31.

Figure 4:
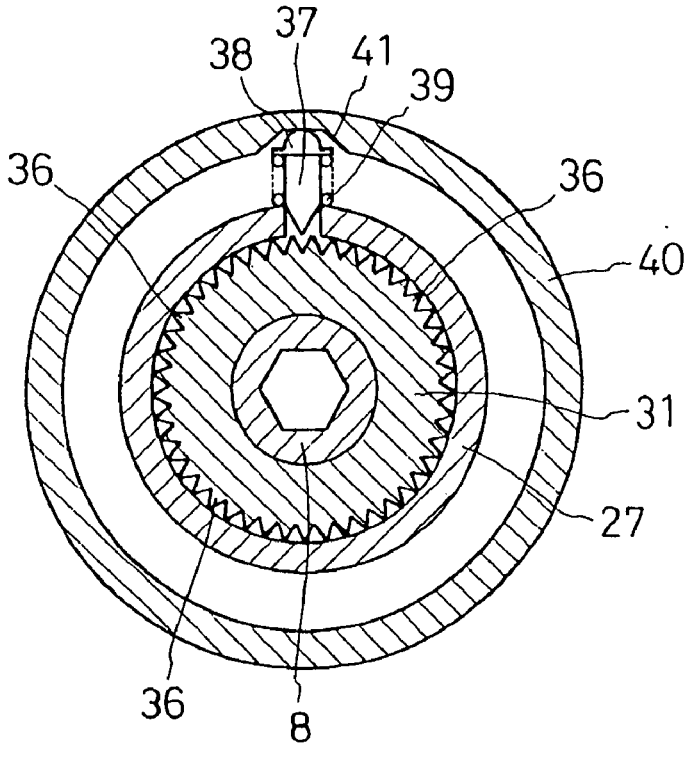
FIG. 4 is a cross section view taken along line A—A of the impact driver (a non-percussion mode).

On the other hand, an engaging pin 37 whose inner edge can engage with engaging gears 36, 36 . . . of the second cam 31 is provided as an engaging member so as to be movable inward and outward in the radial direction of the cylindrical portion 27. The engaging pin 37 has a stopper 38 at its outer edge, and is pressed in the direction away from the second cam 31 by a coil spring 39, which is externally provided to the second cam 31 between the stopper 38 and the outer circumference of the cylindrical portion 27. A cylindrical mode-change ring 40 as an operating member is externally provided to the cylindrical portion 27 so as to be rotatable in order to regulate an outward position of the engaging pin 37. It should be noted that a guide concave portion 41 with lateral sides tapered in the circumferential direction is formed in the inner circumference of the mode-change ring 40. The position of the engaging pin 37 is changeable by aligning and misaligning the guide concave portion 41 and the engaging pin 37 in the circumferential direction in accordance with the rotation of the mode-change ring 40. That is, at the rotative position as shown in FIG. 3 where the guide concave portion 41 is not aligned with the engaging pin 37, the engaging pin 37 moves to the center against the biasing force of the coil spring 39, thereby allowing its inner edge to engage with the engaging gears 36 of the second cam 31 (that is, a percussion mode). On the other hand, at the rotative position as shown in FIG. 4 where the guide concave portion 41 is aligned with the engaging pin 37, the engaging pin 37 moves away from the center being pressed by the coil spring 39, thereby allowing its inner edge to disengage from the engaging gears 36 (that is, a non-percussion mode).

In the above-structured impact driver 1, when the mode-change ring 40 is rotated, a non-percussion mode is selected. In the non-percussion mode, when the trigger 10 is pressed to turn ON the switch 9 in order to drive the motor 3, the reduced speed of rotation of the motor shaft 4 is transferred to the spindle 6. As a result, the anvil 8 is rotated through the hammer 7. With this mechanism, screwing can be performed using a driver bit and the like mounted at the top of the anvil 8. While this screwing, as the anvil 8 is in a backward position pressed by the driver bit, the first cam 29 rotating integrally with the anvil 8 abuts to the second cam 31. In this case, however, the second cam 31 rotates integrally with the first cam 29 since the second cam 31 being disengaged from the engaging pin 37 is freely rotatable. As a result, the percussion does not occur to the anvil 8.

When screwing proceeds to a state in which a load on the anvil 8 increases, the steel balls 20, 20 are rolled backward along the cam grooves 18, 18 of the spindle 6. Consequently, the hammer 7 is moved backward against the biasing force of the coil spring 21 until it disengages from the anvil 8. However, at the moment of this disengagement the hammer 7, which is rotating with the spindle 6, immediately moves forward again being pressed by the coil spring 21 until the engaging nails 23, 23 engage with the arms 22, 22 of the anvil 8. These disengagement and reengagement of the hammer 7 with respect to the anvil 8 are mechanically repeated, which occurs the intermittent impact operation to the anvil 8. In this way, tight screwing can be conducted.

On the other hand, when the percussion mode is selected by operating the mode-change ring 40, the rotation of the second cam 31 is regulated by the engaging pin 37. That is, only the first cam 29 rotates with the anvil 8 at the backward position. Consequently, the cam gears 30 of the first cam 29 which is rotating interfere with the cam gears 32 of the second cam 31 which is regulated its rotation, and therefore the percussion in the axial direction occurs to both the first cam 29 and the anvil 8. In this case, the impact still occurs by the hammer 7, and the percussion as well as the impact can be obtained.

In the impact driver 1 in accordance with the embodiment 1, the anvil 8 is provided so as to be slightly movable in the axial direction. Moreover, the percussion application mechanism, where the percussion to the anvil 8 occurs in accordance with the rotation of the anvil 8, is optionally provided. Because of this, both boring and screwing can be conducted only with the impact driver, whereby improvement of its operability can be expected.

In particular, the percussion application mechanism comprises a first cam 29 externally provided at the anvil 8 for rotating integrally with the same, a second cam 31 inserted into the anvil 8 with play at the rear of the first cam 29 to be regulated its moving in the axial direction, cam gears 30, 32 formed on the first and second cams 29, 31 at opposing faces thereof for contacting with each other at the backward position of the anvil 8, and a regulating means provided in the cylindrical portion 27 of the hammer case 5 so as to regulate rotation of the second cam 31 arbitrarily from the outside of the hammer case 5. With this configuration, the percussion application mechanism can be formed with ease.

Moreover, the regulating means comprises the mode-change ring 40 externally provided on the cylindrical portion 27, and the engaging pin 37 caused to move inward and outward with respect to the second cam 31 in accordance with the operation of the mode-change ring 40 and engages with the second cam 31 at an inward position. With this configuration, the regulating means can be simply formed at the front edge of the housing where handling is easy.

It should be noted that an engaging structure between the second cam and the engaging member is not limited to the above embodiment. Several modifications of the engaging structure can be feasible, for example, the engaging gears of the second cam can be replaced with a protrusion having a wider pitch, the engaging member can be longer in the circumferential direction of the second cam so as to obtain a broader engaging portion, or a plurality of engaging members may be provided. Moreover, the operating member may be a semicircle or a crescentic form, and further, it may be a slide member provided linearly and slidably on the chamfered surface of the housing for moving the engaging member back and forth, not limited to be cylindrical like the mode-change ring.

Further, a click means may be provided between the operating member and the cylindrical portion. This click means serves as an indication of operative positions of two modes, which are the percussion mode and the non-percussion mode. Moreover, another regulating means may be provided which makes the operating member rotate only within two operative positions.

In this embodiment, the engaging member has a structure of engaging with the circumference of the second cam. Alternatively, the present invention may adopt another structure in which an engaging member is provided either the front or back side of the second cam in the axial direction. When the engaging member is moved back and forth by the operation of the operating member, it engages with and disengages from a portion to be engaged such as a concave portion, formed on the front or back side of the second cam.

<Second Embodiment>

Next, another embodiment of an impact driver will be explained. It should be noted that the same components as those in the first embodiment are assigned the same reference numbers and explanation thereof is omitted.

Figure 5:
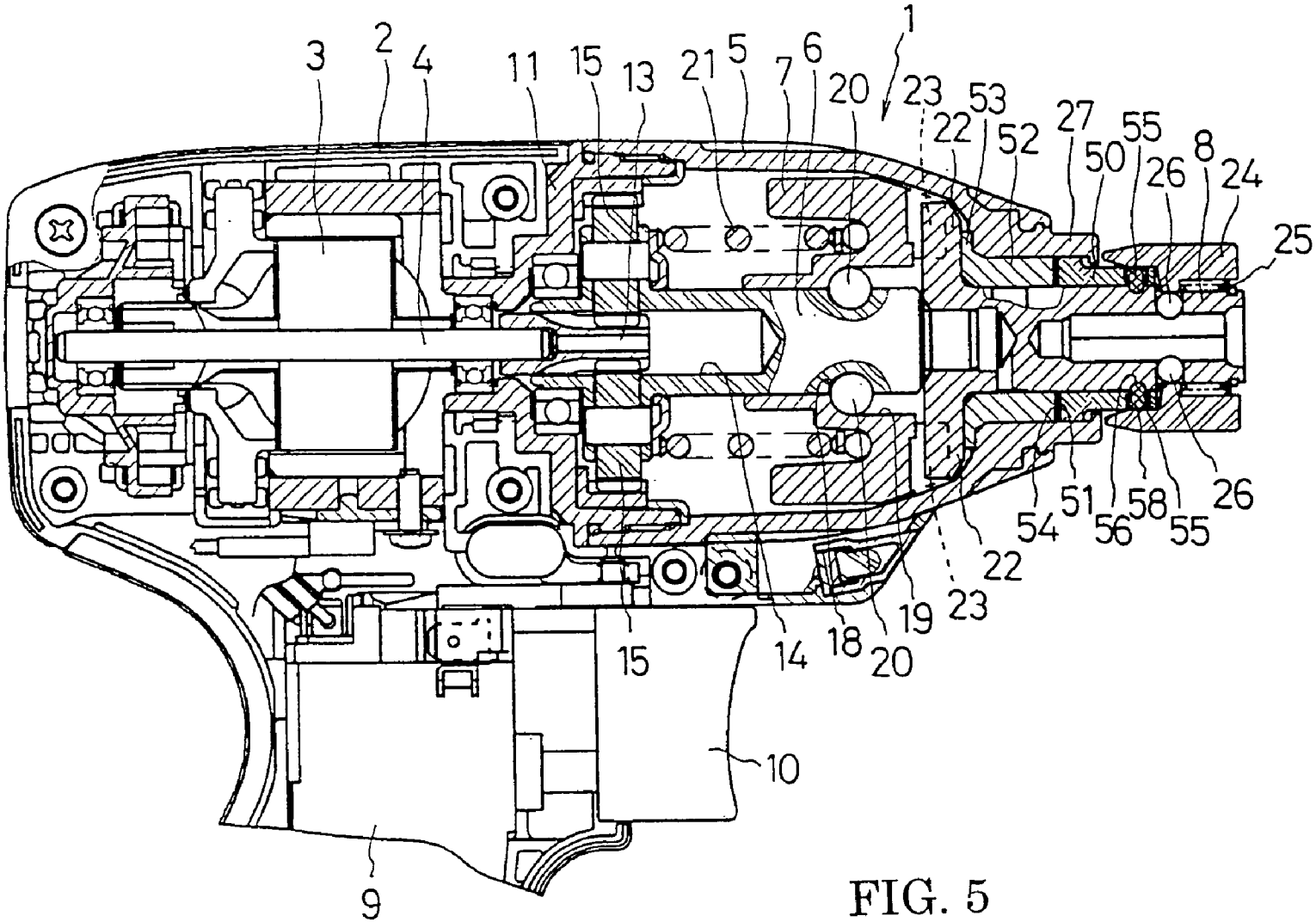
FIG. 5 is a partial vertical section view of an impact driver of the second embodiment (a percussion mode).

In an impact driver 1 as shown in FIG. 5, the anvil 8 has a cylindrical first cam 50 and a second cam 52 which are externally provided from the front respectively. The rear portion of the first cam 50 is axially supported by a cylindrical portion 27 of a hammer case 5, whereby the first cam 50 can move separately from the anvil 8 in the rotating and axial direction. Cam gears 51, 51 . . . are provided at the rear of the first cam 50 in the radial direction. The second cam 52 is pressed into the cylindrical portion 27 from backward to be integral with the hammer case 5. Moreover, the second cam 52 axially supports the anvil 8 and regulates a forward position of the anvil 8 by a flange portion 53 formed at the rear end thereof.

Figure 6:
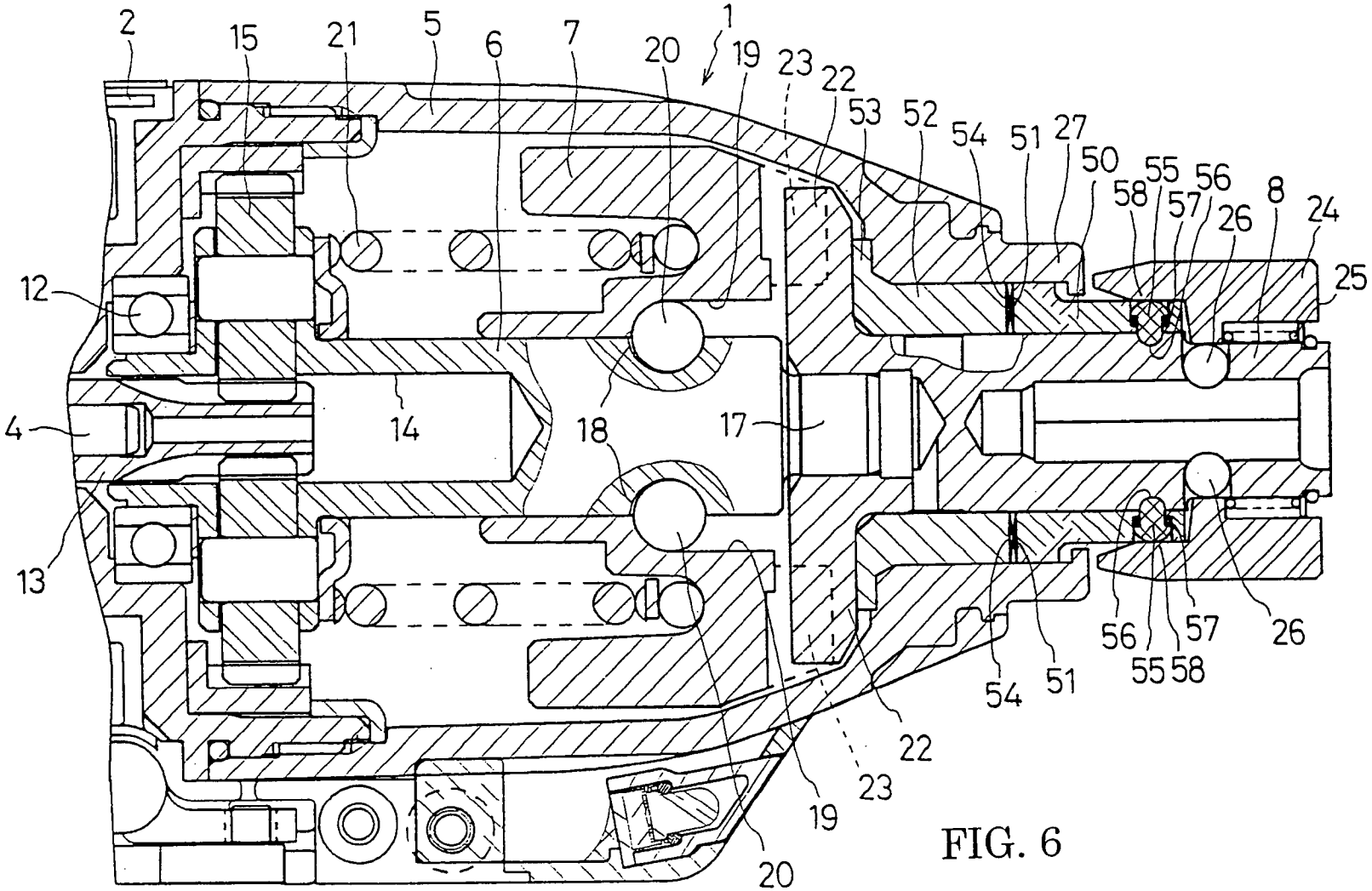
FIG. 6 is an enlarged cross section view of the top portion of the impact driver of the second embodiment.

According to this configuration, the anvil 8 can slightly move back and forth in the axial direction between a backward portion where the arms 22, 22 abut to the large-diameter unit of a spindle 6 and a forward portion as shown in FIGS. 5 and 6 where the arms 22, 22 abut to the flange portion 53 of the second cam 52. The reference number 54, 54 . . . denotes cam gears formed on a surface of the second cam 52 in the radial direction. The surface having the cam gears 54, 54 . . . opposes to a surface of the first cam 50.

On the other hand, at the front portion of the first cam 50, a pair of flange pins 55, 55 serving as engaging members are provided externally at the rear portion of the chuck sleeve 24. The flange pins 55, 55 are inserted with play so as to be movable inward and outward in the radial direction of the first cam 50. At an inward position, the flange pin can engage with a plurality of concave portions 56, 56 . . . arranged in the circumference direction at the periphery of the anvil 8 serving as portions to be engaged. As shown in FIG. 6, each flange pin 55 is usually pressed by a coil spring 57 externally provided thereto in the outward direction where the top of the flange pin abuts to the inner surface of the chuck sleeve 24. In the inner surface of the chuck sleeve 24, guide convex portions 58, 58 having a tapered portion in the circumference direction protrude so as to interfere with the head portion of the flange pin 55. By rotating the chuck sleeve 24, the convex portion 58 moves in the circumference direction between a position where the guide convex portion 58 is aligned with the flange pin 55 and a portion where it is not aligned with the same, whereby the position of the flange pin 55 can be changed.

Figure 7:
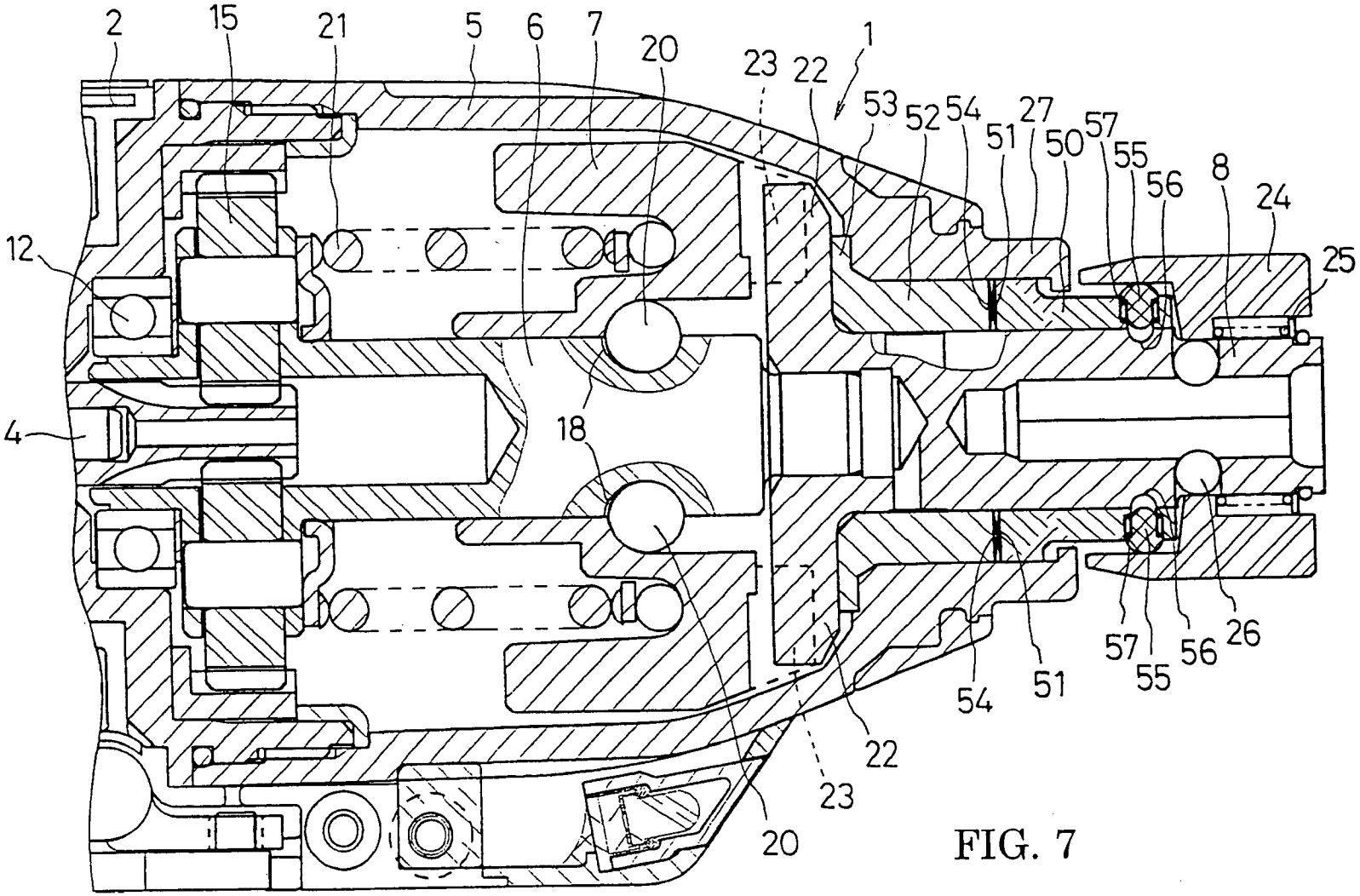
FIG. 7 is an enlarged cross section view of the top portion of the impact driver of the second embodiment in the non-percussion mode.

That is, in the rotative position as shown in FIG. 6 where the guide convex 58 is aligned with the flange pin 55, each flange pin 55 protrudes to the center against the biasing force of the coil spring 57, thereby engaging its inner edge with a concave portion 56 of the anvil 8 (a percussion mode). On the other hand, in the rotative position as shown in FIG. 7 where the guide convex 58 is not aligned with the flange pin 55, the flange pin 55 is moved outward pressed by the coil spring 57, thereby disengaging its inner edge from the concave portion 56 (a non-percussion mode). When a driver bit and the like is mounted on or detached from the anvil 8, the chuck sleeve is made to move forward against the biasing force of the coil spring 25 in order to release the regulation to a ball 26 pressing to the center side. Even in this case, the flange pin 55 is designed to maintain its abutment status regardless of the axial movement of the chuck sleeve 24.

In the above-structured impact driver 1, a non-percussion mode is selected by rotating the chuck sleeve 24. In the non-percussion mode, the trigger 10 is pressed to turn ON the switch 9, and the motor 3 is driven to make the anvil 8 rotate similar to the first embodiment. Then, the hammer 7 applies the intermittent impact to anvil 8 when a load to the anvil 8 increases. Here, even if the anvil 8 is in a backward position, the first cam 50 is freely rotatable because the flange pin 55 does not engage with the concave portion 56. Therefore, the percussion does not occur to the anvil 8 although the first cam 50 abuts to the second cam 52.

On the other hand, when a percussion mode is selected by rotating the chuck sleeve 24, the first cam 50 is connected to the anvil 8 by the flange pins 55, 55. Consequently, when the anvil 8 at a backward position is rotated, the cam gears 51 of the first cam 50 which rotates integrally with the anvil 8, interferes with the cam gears 54 of the second cam 52. Because of this, the percussion in the axial direction occurs to both the first cam 50 and the anvil 8, whereby percussion and impact can be obtained concurrently.

Also in the impact driver 1 of the second embodiment, as the percussion application mechanism is optionally provided, both boring and screwing can be conducted with one impact driver only, so that improvement of operability can be expected.

In particular, the percussion application mechanism comprises a first cam 50 being externally provided at the anvil 8 for rotating separately from the anvil 8 and on which a part of the chuck sleeve 24 mounts externally, a second cam 52 inserted into the anvil 8 with play at rear of the first cam 50 and fixed to the side of the hammer case 5, cam gears 51, 54 formed on the first and second cams 50, 52 at opposing faces thereof for contacting each other at the backward position of the anvil 8, and a regulating means provided between the chuck sleeve 24 and the anvil 8 and capable of arbitrarily regulating the rotation of the first cam 50 by means of the rotative operation of the chuck sleeve 24. In other words, the chuck sleeve 24 for attaching or detaching a bit also serves as a mode-change ring, thereby requiring a slight model change from a conventional impact driver. In this way, the percussion application mechanism can be advantageously formed with a lower cost.

In addition, the regulating means comprises the concave portion 56 provided at the outer circumference of the anvil 8 and the flange pin 55 inserted into the first cam 50 with play in the radial direction. The flange pin 55 is designed so as to move inward and outward with respect to the anvil 8 in accordance with the rotative operation of the chuck sleeve 24 and engage with the concave portion 56 at an inward position. With this configuration, the regulating means can be simply formed, utilizing the chuck sleeve 24 provided at the top of the anvil 8.

Similarly to the first embodiment, in the second embodiment several modifications can be arbitrarily made. For example, the number and shape of the flange pin, or the shape of the first cam and the second cam and so on may be modified. Regarding the chuck sleeve, the portion abutting to the engaging means may be partially extended, or a separate sleeve may be provided externally with the first cam so as to abut to the engaging means. Also similar to the first embodiment, a click means may be provided between the chuck sleeve and the anvil. This click means serves as an indication of operative positions of two modes, which are the percussion mode and the non-percussion mode. Moreover, another regulating means may be provided which makes the operating member rotate only within two operative positions.

In the above first and second embodiments, an impact driver in which the hammer is used for applying impact to the anvil is shown. Alternatively, an impact driver employing an oil unit may be acceptable, in which a supplied continuous torque is converted into an intermittent torque and transferred to the spindle when the inner oil pressure increases. In this case, the spindle or the entire oil unit may be slightly movable in the axial direction, and the percussion application mechanism as described in the above embodiments may be provided between the housing and the spindle, or between the spindle and the chuck sleeve.

What is claimed is:

1. An impact driver comprising:

a motor housed in a housing;

an output shaft protruding from the housing and provided so as to slightly move back and forth in the axial direction;

a rotation impact mechanism for transferring a motor torque to the output shaft while applying the impact operation in the rotative direction in accordance with increase of a torque load on the output shaft, a percussion application mechanism for generating percussion to the output shaft in the axial direction in accordance with rotation of the output shaft, and a regulating means, provided with the housing, which can from outside the housing arbitrarily select between a percussion mode in which the percussion application mechanism is activated and a non-percussion mode in which the percussion application mechanism is stopped, wherein the percussion application mechanism comprises:

a first cam externally provided at the output shaft for rotating integrally with the same, a second cam inserted into the output shaft with play at the rear of the first cam, and the second cam is regulated in its moving in the axial direction, cam gears formed on the first and second cams at opposing faces thereof for contacting with each other at the backward position of the output shaft, and wherein by means of the regulating means, the percussion mode can be selected for regulating the rotation of the second cam and the non-percussion mode can be selected for releasing the regulation of the rotation of the second cam.

2. An impact driver as recited in claim 1, wherein the regulating means comprises an operating member provided at the outside of the housing and an engaging member moving inward and outward with respect to the second cam in accordance with the operation of the operating member to engage with the second cam at an inward position.

3. An impact driver as recited in claim 2, wherein the operating member is a cylindrical mode-change ring provided so as to be rotatable in the housing and having a concave portion in its inner circumference, and the engaging member is a pin member movable inward and outward with respect to the housing in the radial direction and being pressed in the direction away from the second cam to abut to the inner circumference of the mode-change ring, wherein with the rotative operation of the mode-change ring, the pin member moves outward to disengage from the second cam when the concave portion aligns with the pin member, and the pin member moves inward to engage with the second cam when the concave portion and the pin member are misaligned, respectively.

4. An impact driver comprising:

a motor housed in a housing;

an output shaft protruding from the housing and provided so as to slightly move back and forth in the axial direction;

a rotation impact mechanism for transferring a motor torque to the output shaft while applying the impact operation in the rotative direction in accordance with increase of a torque load on the output shaft, a percussion application mechanism for generating percussion to the output shaft in the axial direction in accordance with rotation of the output shaft, and a regulating means, provided with the housing, which can from outside the housing arbitrarily select between a percussion mode in which the percussion application mechanism is activated and a non-percussion mode in which the percussion application mechanism is stopped, wherein at the top of the output shaft the impact driver has a chuck sleeve for attaching or detaching a tool on the output shaft by its sliding operation in the axial direction, wherein the percussion application mechanism comprises:

a first cam being externally provided at the output shaft for rotating separately from the output shaft and on which a part of the chuck sleeve mounts externally, a second cam inserted into the output shaft with play at the rear of the first cam and fixed to the side of the housing, cam gears formed on the first and second cams at opposing faces thereof for contacting with each other at the backward position of the output shaft, and a regulating means provided between the chuck sleeve and the output shaft and capable of arbitrarily regulating the rotation of the first cam by means of the rotative operation of the chuck sleeve, and wherein by means of the regulating means, the percussion mode can be selected for regulating the rotation of the first cam and the non-percussion mode can be selected for releasing the regulation of the rotation of the first cam.

5. An impact driver as recited in claim 4, wherein the regulating means comprises a portion to be engaged provided at the outer circumference of the output shaft and an engaging member inserted into the first cam with play in the radial direction and moving inward and outward with respect to the output shaft in accordance with the rotative operation of the chuck sleeve for engaging with the portion to be engaged at an inward position.

6. An impact driver as recited in claim 5, wherein the portion to be engaged is a concave portion formed in the outer circumference of the output shaft and the regulating means is a pin member pressed in the direction away from the first cam to abut to the inner circumference of the chuck sleeve, wherein with the rotative operation of the chuck sleeve having a convex portion in its inner circumference, the pin member moves inward to engage with the concave portion when the convex portion aligns with the pin member, and the pin member moves outward to disengage from the concave portion when the convex portion and the pin member are misaligned, respectively.

* * * * *